US007665304B2

(12) United States Patent
Sundel

(10) Patent No.: US 7,665,304 B2
(45) **Date of Patent: *Feb. 23, 2010**

(54) RANKINE CYCLE DEVICE HAVING MULTIPLE TURBO-GENERATORS

(75) Inventor: Timothy Neil Sundel, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/000,101

(22) Filed: Nov. 30, 2004

(65) Prior Publication Data

US 2006/0112692 A1 Jun. 1, 2006

(51) Int. Cl.
*F01K 25/00* (2006.01)

(52) U.S. Cl. ..... 60/671; 60/676; 60/677

(58) Field of Classification Search ..... 60/645, 60/649, 670, 671, 676, 677, 597
See application file for complete search history.

(56) References Cited

U.S. PATENT DOCUMENTS 3,220,229 A 11/1965 Livesay
3,302,401 A 2/1967 Rockenfeller ..... 6/649
3,512,901 A * 5/1970 Law ..... 417/53
3,613,368 A 10/1971 Doerner ..... 60/657
3,873,817 A * 3/1975 Liang ..... 700/287
3,992,894 A * 11/1976 Antonetti et al. ..... 62/129
4,166,361 A 9/1979 Earnest et al. ..... 60/39
4,244,191 A 1/1981 Hendriks ..... 6/728
4,276,747 A * 7/1981 Faldella et al. ..... 60/618
4,342,200 A 8/1982 Lowi, Jr.
4,386,499 A 6/1983 Raviv et al. ..... 60/657
4,407,131 A * 10/1983 Wilkinson ..... 60/648
4,422,297 A * 12/1983 Rojey ..... 60/651
4,516,403 A 5/1985 Tanaka
4,590,384 A 5/1986 Bronicki ..... 290/4 C
4,593,527 A 6/1986 Nakamoto et al.
4,604,714 A * 8/1986 Putman et al. ..... 700/288
4,617,808 A 10/1986 Edwards ..... 62/472
4,753,077 A * 6/1988 Rosenblatt ..... 60/661

(Continued)

FOREIGN PATENT DOCUMENTS

DE 19630559 1/1998

(Continued)

OTHER PUBLICATIONS

Energy—The Spark and Lifeline of Civilization, 17th Intersociety Energy Conversion Engineering Conference, "The Racer System", Cipolia, R.F. and Collins, D.J.; pp. 1433-1436.

(Continued)

*Primary Examiner*—Hoang M Nguyen
(74) *Attorney, Agent, or Firm*—Kinney & Lange, P.A.

(57) ABSTRACT

A method for generating power, comprising the steps of: a) providing a Rankine Cycle device that includes a plurality of turbo-generators, each including a turbine coupled with an electrical generator, and at least one of each of an evaporator, a condenser, and a refrigerant feed pump; b) disposing the one or more evaporators within an exhaust duct of a power plant of a marine vessel; c) operating the power plant; and d) selectively pumping refrigerant through the Rankine Cycle device.

11 Claims, 10 Drawing Sheets

U.S. PATENT DOCUMENTS

| | | | | |
|---|---|---|---|---|
| 4,760,705 | A | 8/1988 | Yogev et al. | 60/651 |
| 4,901,531 | A | 2/1990 | Kubo et al. | 60/618 |
| 5,000,003 | A | 3/1991 | Wicks | 60/618 |
| 5,038,567 | A | 8/1991 | Mortiz | 60/641.5 |
| 5,113,927 | A | 5/1992 | Kedar et al. | 165/13 |
| 5,119,635 | A | 6/1992 | Harel | 60/692 |
| 5,174,120 | A | 12/1992 | Silvestri, Jr. | 60/692 |
| 5,335,508 | A * | 8/1994 | Tippmann | 62/129 |
| 5,339,632 | A | 8/1994 | McCrabb et al. | 60/618 |
| 5,509,466 | A | 4/1996 | McQuade et al. | 165/113 |
| 5,548,957 | A * | 8/1996 | Salemie | 60/641.8 |
| 5,598,706 | A | 2/1997 | Bronicki et al. | 60/641.2 |
| 5,632,143 | A | 5/1997 | Fisher et al. | 60/39.182 |
| 5,640,842 | A | 6/1997 | Bronicki | 60/39.181 |
| 5,647,221 | A * | 7/1997 | Garris, Jr. | 62/116 |
| 5,664,419 | A | 9/1997 | Kaplan | 60/641.2 |
| 5,761,921 | A | 6/1998 | Hori et al. | 62/238.4 |
| 5,799,484 | A * | 9/1998 | Nims | 60/39.15 |
| 5,809,782 | A | 9/1998 | Bronicki et al. | 60/641.2 |
| 5,843,214 | A | 12/1998 | Janes | |
| 5,860,279 | A | 1/1999 | Bronicki et al. | 60/655 |
| 6,009,711 | A | 1/2000 | Kreiger et al. | 60/641.2 |
| 6,052,997 | A | 4/2000 | Rosenblatt | 60/653 |
| 6,101,813 | A | 8/2000 | Sami et al. | 60/671 |
| 6,497,090 | B2 | 12/2002 | Bronicki et al. | 60/39.6 |
| 6,522,030 | B1 * | 2/2003 | Wall et al. | 307/43 |
| 6,539,718 | B2 | 4/2003 | Bronicki et al. | 60/641.2 |
| 6,539,720 | B2 | 4/2003 | Rouse et al. | 60/651 |
| 6,539,723 | B2 | 4/2003 | Bronicki et al. | 60/774 |
| 6,571,548 | B1 | 6/2003 | Bronicki et al. | 60/39.02 |
| 6,698,423 | B1 | 3/2004 | Honkonen et al. | |
| 6,880,344 | B2 | 4/2005 | Radcliff et al. | 60/772 |
| 6,892,522 | B2 | 5/2005 | Brasz et al. | 60/39.181 |
| 7,121,906 | B2 | 10/2006 | Sundel | 440/3 |
| 7,146,813 | B2 | 12/2006 | Brasz et al. | 60/651 |
| 2002/0100271 | A1 | 8/2002 | Viteri et al. | 60/39 |
| 2002/0148225 | A1 | 10/2002 | Lewis | 60/670 |
| 2003/0029169 | A1 | 2/2003 | Hanna et al. | 60/651 |
| 2003/0089110 | A1 | 5/2003 | Niikura et al. | 60/618 |
| 2003/0167769 | A1 | 9/2003 | Bharathan et al. | 60/676 |
| 2004/0088983 | A1 | 5/2004 | Brasz | 60/651 |
| 2004/0088985 | A1 | 5/2004 | Brasz et al. | 60/670 |
| 2004/0088986 | A1 | 5/2004 | Brasz et al. | 60/671 |
| 2006/0026961 | A1 | 2/2006 | Bronicki | 60/641.2 |

FOREIGN PATENT DOCUMENTS

| | | | |
|---|---|---|---|
| DE | 19907512 | | 8/2000 |
| DE | 10029732 | | 1/2002 |
| EP | 1243758 | A1 | 9/2002 |
| EP | 1555396 | A1 | 7/2005 |
| JP | 52046244 | | 4/1977 |
| JP | 54045419 | | 4/1979 |
| JP | 54060634 | | 5/1979 |
| JP | 55091711 | | 7/1980 |
| JP | 58088409 | | 5/1983 |
| JP | 58122308 | | 7/1983 |
| JP | 59043928 | | 3/1984 |
| JP | 59054712 | | 3/1984 |
| JP | 59063310 | | 4/1984 |
| JP | 59138707 | | 8/1984 |
| JP | 59158303 | | 9/1984 |
| JP | 60158561 | | 8/1985 |
| JP | 6088523 | | 3/1994 |
| JP | 2002266655 | | 9/2002 |
| JP | 2002285805 | | 10/2002 |
| JP | 2002285907 | | 10/2002 |
| JP | 2003161101 | | 6/2003 |
| JP | 2003161114 | | 6/2003 |
| JP | 2005019907 | A | 1/2005 |
| WO | WO98/06791 | | 2/1998 |
| WO | WO02/099279 | A1 | 12/2002 |
| WO | WO03/078800 | A1 | 9/2003 |

OTHER PUBLICATIONS

Heat Recovery Steam Generator Hot Start Testing, Section 3, Racer Report, pp. 3-1-3-31.

Heat Recovery Steam Generator Noise, Section 4, Racer Report, pp. 4-1-4-35 and 4-46-4-51.

Heat Recovery Steam Generator Inlet Gas Flow and Exit Steam Temperature Distribution, Section 5, Racer Report, pp. 5-1-5-19.

Racer Heat Recovery Steam Generator Miscellaneous, Section 6, Racer Report, pp. 6-1-6-24.

Steam Turbine Auto Start/Bowed Rotor Testing, Section 11, Racer Report, pp. 11-1-11-19.

Racer System Hot Steam Valve Failures, Section 15, Racer Report, pp. 15-1-15-11.

Miscellaneous Facility Problems, Section 20, Racer Report, pp. 20-1-20-5.

Racer Water Chemistry Evaluation, Section 21, Racer Report, pp. 21-1-21-18.

Geothermal Energy, "Information on the Navy's Geothermal Program"—United States General Accounting Office, GAO-04-513, Jun. 2004, pp. 1-37.

http://www.otsg.com/pages/profile/pro_history.html.

http://thomas.loc.gov/cgi-bin/bdquery/z?d099:HR04428:@@@D&summ2=m&.

http://www.acq.osd.mil/dsb/fuel.pdf pp. 59 & 60.

International Search Report for International application No. PCT/US05/42438 dated Aug. 18, 2007.

* cited by examiner

RANKINE CYCLE DEVICE HAVING MULTIPLE TURBO-GENERATORS

BACKGROUND OF THE INVENTION

1. Technical Field

The present invention relates to methods and apparatus utilizing Rankine Cycle devices in general, and to those methods and apparatus that utilize Rankine Cycle devices to generate electrical power in particular.

2. Background Information

Marine and land based power plants can produce exhaust products in a temperature range of 350-1800° F. In most applications, the exhaust products are released to the environment and the thermal energy is lost. In some instances, however, the thermal energy is further utilized. For example, the thermal energy from the exhaust of an industrial gas turbine engine (IGT) has been used as the energy source to drive a Rankine Cycle system.

Rankine Cycle systems can include a turbine coupled to an electrical generator, a condenser, a pump, and a vapor generator. The vapor generator is subjected to a heat source (e.g., geothermal energy source). The energy from the heat source is transferred to a fluid passing through the vapor generator. The energized fluid subsequently powers the turbine. After exiting the turbine, the fluid passes through the condenser and is subsequently pumped back into the vapor generator. In land-based applications, the condenser typically includes a plurality of airflow heat exchangers that transfer the thermal energy from the water to the ambient air.

In the 1970's and 1980's the United States Navy investigated a marine application of a Rankine Cycle system, referred to as the Rankine Cycle Energy Recovery (RACER) System. The RACER system, which utilized high-pressure steam as the working medium, was coupled to the drive system to augment propulsion horsepower. RACER could not be used to power any accessories because it as coupled to the drive system; i.e., if the drive system was not engaged, neither was the RACER system. The RACER system was never fully implemented and the program was cancelled because of problems associated with using high-pressure steam in a marine application.

What is needed is a method and apparatus for power generation using waste heat from a power plant that can be used in a marine environment, and one that overcomes the problems associated with the prior art systems.

SUMMARY OF THE INVENTION

According to the present invention, a method and apparatus for generating power aboard a marine vessel is provided. The method comprises the steps of:

The present method and apparatus can be operated to produce a significant amount of electrical energy and to significantly reduce the temperature of the exhaust products being released to the environment.

The range of a marine vessel that burns liquid fossil fuel within its power plant is typically dictated by the fuel reserve it can carry. In most modern marine vessels, a portion of the fuel reserve is devoted to running a power plant that generates electrical energy. Hence, both the propulsion needs and the electrical energy needs draw on the fuel reserve. The present method and apparatus decreases the fuel reserve requirements by generating electricity using waste heat generated by the power plant of the vessel rather than fossil fuel. Hence, the vessel is able to carry less fuel and have the same range, or carry the same amount of fuel and have a greater range. In addition, less fuel equates to lower weight, and lower weight enables increased vessel speed.

The significantly reduced exhaust temperatures made possible by the present invention enable the use of an exhaust duct, or stack, with a smaller cross-sectional area. The mass flow of the power plant exhaust is a function of the volumetric flow and density of the exhaust. The significant decrease in exhaust temperature increases the density of the exhaust. As a result, the mass flow is substantially decreased, and the required size of the marine power plant exhaust duct is substantially less.

The present method and apparatus also provide advantages with respect to the stability of the vessel. For example, the present method and apparatus produces electrical energy via waste heat. Conventional marine systems produce electrical energy by consuming liquid fuel. As the fuel is depleted, the buoyancy characteristics of the vessel are changed. The weight of the present apparatus, on the other hand, remains constant and thereby facilitates stability control of the vessel. In addition, the weight of the present apparatus can be advantageously positioned within the vessel to optimize the stability of the vessel.

The stability of the vessel is also improved by the smaller exhaust duct, which is enabled by the present invention. The smaller exhaust duct decreases the weight of vessel components disposed above the center of gravity of the vessel, thereby increasing the stability of the vessel.

For those embodiments that utilize a recuperator disposed within the condenser, the present inventor provides the additional benefits of an ORC device with increase efficiency disposed within a relatively compact unit.

The present invention apparatus and method are operable any time the vessel's power plant is operational. There is no requirement that the vessel be underway, because the present method and apparatus are independent of the vessel's drive system.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
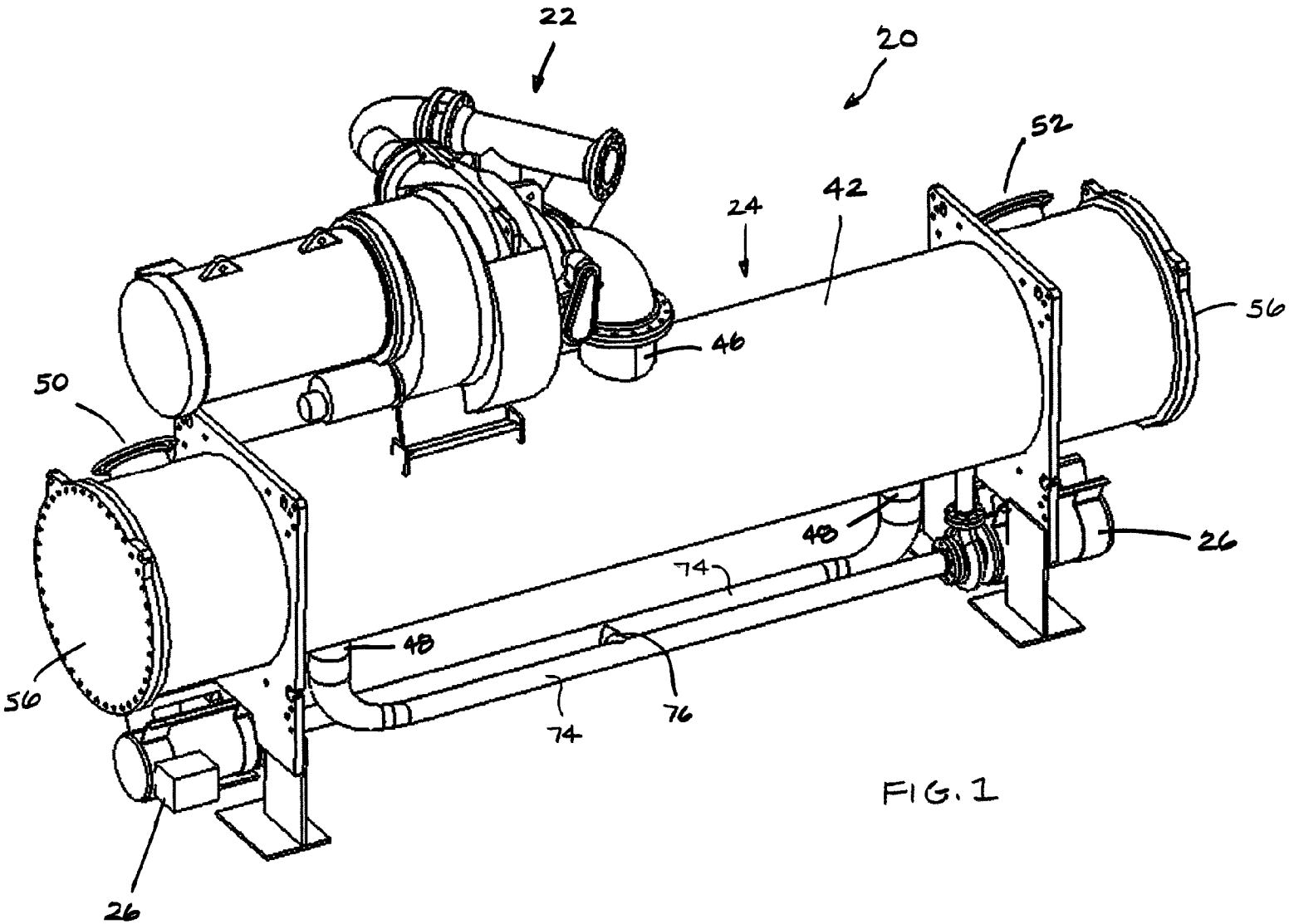
FIG. 1 is a diagrammatic perspective view of an embodiment of the present invention ORC device, having a single turbo-generator.

Referring to FIGS. 1-6, the present method for utilizing waste heat includes an organic Rankine Cycle (ORC) device 20 for waste heat utilization. The ORC device 20 includes at least one of each of the following: 1) a plurality of turbines, each coupled with an electrical generator (together hereinafter each couple referred to as the "turbo-generator 22"); 2) a condenser 24; 3) a refrigerant feed pump 26; 4) an evaporator 28; and 5) a control system. The ORC device 20 is preferably a closed "hermetic" system with no fluid makeup. In the event of leaks, either non-condensables are automatically purged from the device 20 or charge is manually replenished from refrigerant gas cylinders.

The ORC device 20 uses a commercially available refrigerant as the working medium. An example of an acceptable working medium is R-245fa (1,1,1,3,3, pentafluoropropane). R-245fa is a non-flammable, non-ozone depleting fluid. R-245fa has a saturation temperature near 300° F. and 300 PSIG that allows capture of waste heat over a wide range of IGT exhaust temperatures.

Now referring to FIGS. 1-4, each turbo-generator includes a single-stage radial inflow turbine 30 that typically operates at about 18000 rpm, a gearbox 32 with integral lubrication system, and an induction generator 34 operating at 3600 rpm. The gearbox 32 includes a lubrication system. In some instances, the gearbox lubrication system is integral with the gearbox 32.

In one embodiment, each turbo-generator 22 is derived from a commercially available refrigerant compressor-motor unit; e.g., a Carrier Corporation model 19XR compressor-motor. As a turbine, the compressor is operated with a rotational direction that is opposite the direction it rotates when functioning as a compressor. Modifications performed to convert the compressor into a turbine include: 1) replacing the impeller with a rotor having rotor blades shaped for use in a turbine application; 2) changing the shroud to reflect the geometry of the rotor blades; 3) altering the flow area of the diffuser to enable it to perform as a nozzle under a given set of operating conditions; and 4) eliminating the inlet guide vanes which modulate refrigerant flow in the compressor mode. To the extent that there are elements within the 19XR compressor that have a maximum operating temperature below the operating temperature of the turbine 30, those elements are replaced or modified to accommodate the higher operating temperature of the turbine 30.

In some embodiments, each turbo-generator 22 includes peripheral components such as an oil cooler 36 (shown schematically in FIGS. 7-10) and oil reclaim eductor (not shown). Both the oil cooler 36 and the eductor and their associated plumbing are attached to the turbo-generator 22.

Figure 6:
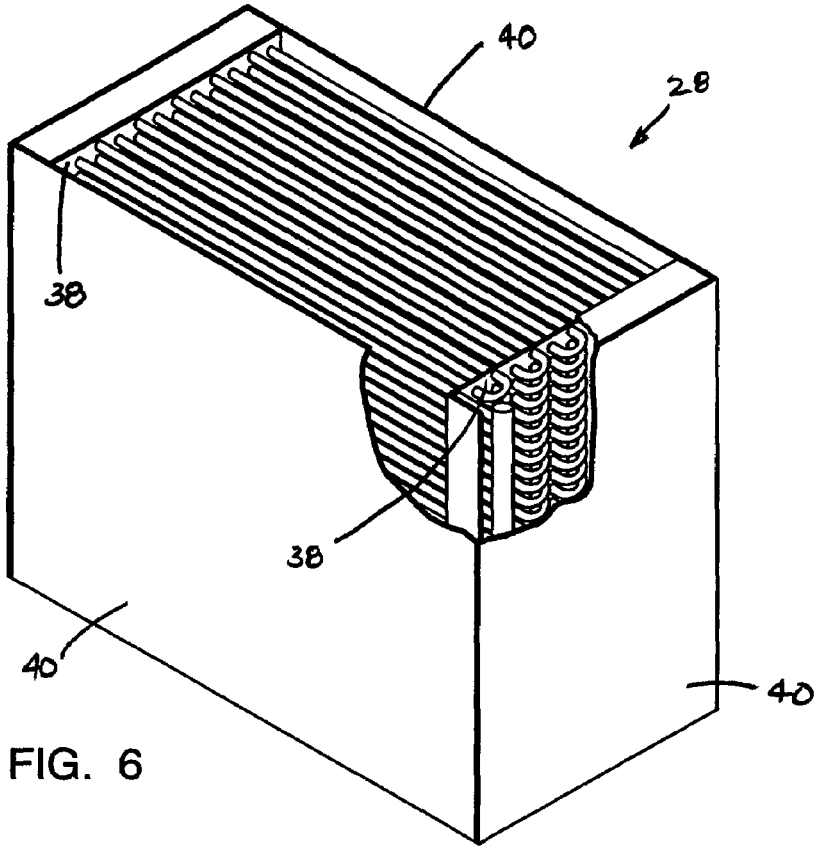
FIG. 6 is a diagrammatic perspective view of an evaporator.
Figure 11:
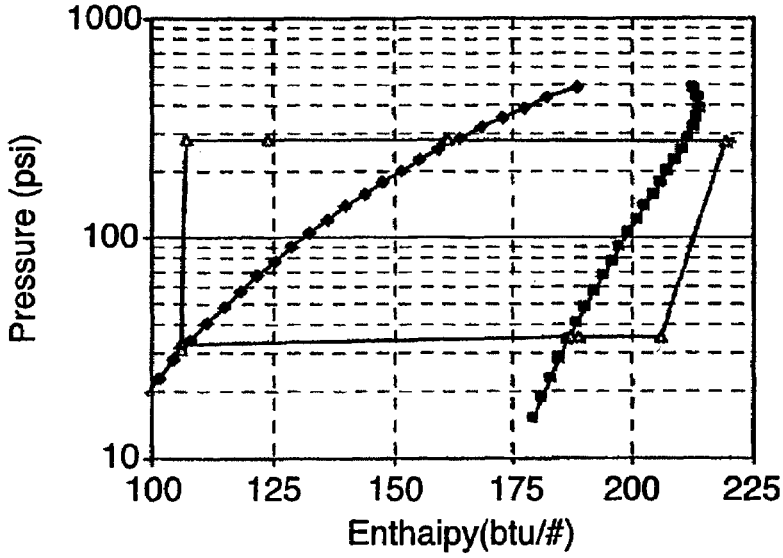
FIG. 11 is a diagrammatic pressure and enthalpy curve illustrating the Rankine Cycle.

Referring to FIG. 6, a number of different evaporators 28 can be used with the ORC device 20. A single pressure once-through evaporator 28 with vertical hot gas flow and horizontal flow of refrigerant through fin-tube parallel circuits serviced by vertical headers is an acceptable type of evaporator 28. Examples of acceptable evaporator tube materials include carbon steel tubes with carbon steel fins, and stainless steel tubes with carbon steel fins, both of which have been successfully demonstrated in exhaust gas flows at up to 900° F. Other evaporator tube materials may be used alternatively. Inlet header flow orifices are used to facilitate refrigerant flow distribution. Different refrigerant flow configurations through the evaporator 28 can be utilized; e.g., co-flow, co-counterflow, co-flow boiler/superheater and a counterflow preheater, etc. The present evaporator 28 is not limited to any particular flow configuration.

In all the evaporator 28 embodiments, the number of preheater tubes and the crossover point are selected in view of the desired hot gas exit temperature as well as the boiler section inlet subcooling. A pair of vertical tube sheets 38, each disposed on an opposite end of the evaporator 28, supports evaporator coils. Insulated casings 40 surround the entire evaporator 28 with removable panels for accessible cleaning.

The number of evaporators 28 can be tailored to the application. For example, if there is more than one exhaust duct, an evaporator 28 can be disposed in each exhaust duct. More than one evaporator 28 disposed in a particular duct also offers the advantages of redundancy and the ability to handle a greater range of exhaust mass flow rates. At lower exhaust flow rates a single evaporator 28 may provide sufficient cooling, while still providing the energy necessary to power the turbo-generators 22. At higher exhaust flow rates, a plurality of evaporators 28 may be used to provide sufficient cooling and the energy necessary to power the turbo-generators 22.

Referring to FIGS. 1-5, the condenser 24 is a shell-and-tube type unit that is sized to satisfy the requirements of the ORC device. The condenser 24 includes a housing 42 and a plurality of tubes 44 (hereinafter referred to as a "bank of tubes") disposed within the housing 42. The housing 42 includes a working medium inlet port 46, a working medium exit port 48, a coolant inlet port 50, and a coolant exit port 52. The coolant inlet and exit ports 50, 52 are connected to the bank of tubes 44 to enable cooling fluid to enter the condenser 24 housing, pass through the bank of tubes 44, and subsequently exit the condenser housing 42. Likewise, the working medium inlet and exit ports 46,48 are connected to the condenser housing 42 to enable working medium to enter the housing 42, pass around the bank of tubes 44, and subsequently exit the housing 42. In some embodiments, one or more diffuser plates 54 (see FIG. 5) are positioned adjacent the working medium inlet 46 to facilitate distribution of the working medium within the condenser 24. In the embodiment shown in FIGS. 1-4, the housing 42 includes a removable access panel 56 at each axial end of the housing 42. In a preferred embodiment, one of the access panels 56 is pivotally attached to one circumferential side of the housing 42 and attachable to the opposite circumferential side via a selectively operable latch (not shown) so that the access panel 56 may be readily pivoted to provide access to the bank of tubes 44.

In some embodiments, a non-condensable purge unit 58 (shown schematically in FIGS. 7-9) is attached to the condenser 24. The purge unit 58 is operable to extract air and water vapor that may accumulate in the vapor region of a condenser housing 42 to minimize or eliminate their contribution to oil hydrolysis or component corrosion. The purge unit 58 is actuated only when the system controller thermodynamically identifies the presence of non-condensable gas.

Figure 5:
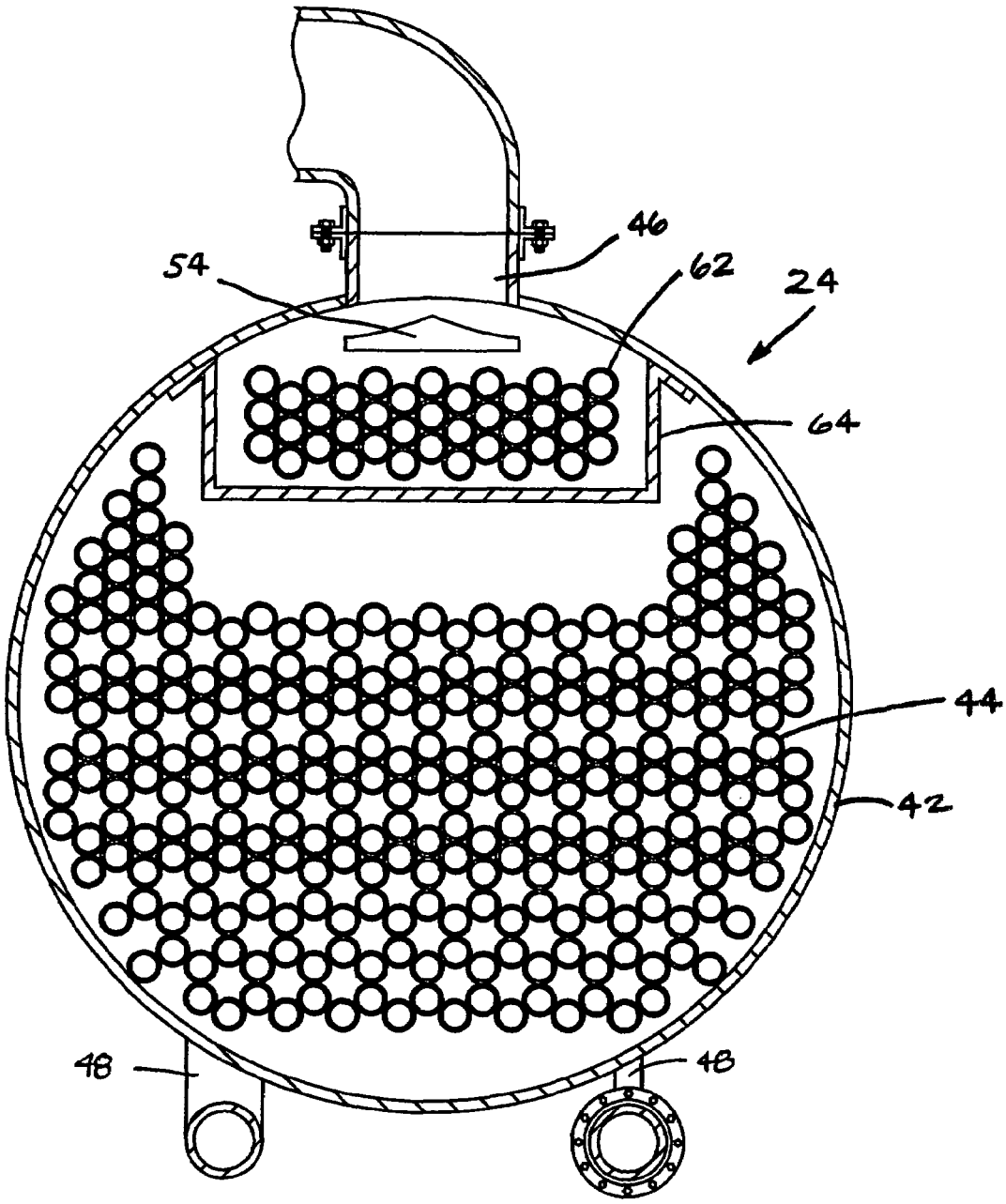
FIG. 5 is a sectional planar view of a condenser.

Referring to FIG. 5, in some embodiments, the ORC device 20 includes a recuperator 60 for preheating the working medium prior to its entry into the evaporator 28. The recuperator 60 is operable to receive thermal energy from at least a portion of the working medium exiting the turbo-generator 22 and use it to preheat working medium entering the evaporator 28. In the embodiment shown in FIG. 5, the recuperator 60 includes a plurality of ducts 62 disposed within the housing 42 of the condenser 24. The ducts 62 are connected inline downstream of the working medium exit port 48 of the condenser 24 and upstream of the evaporator 28. A partition 64 partially surrounds the recuperator ducts 62 to separate them from the remainder of the condenser 24. Working medium enters the condenser 24 through the working medium inlet port 46 and passes through the recuperator 60 prior to entering the remainder of the condenser 24. One or more diffusers 54 can be disposed within the recuperator to facilitate distribution of the working medium within the recuperator 60. Placing the recuperator 60 within the condenser 24 advantageously minimizes the size of the ORC device 20. A recuperator 60 disposed outside of the condenser 24 can be used alternatively, however.

Referring to FIGS. 1-4, the ORC device 20 includes one or more variable speed refrigerant feed pumps 26 to supply liquid refrigerant to the evaporator 28. In one embodiment, the refrigerant feed pump 26 is a turbine regenerative pump that supplies liquid refrigerant to the evaporator 28 with relatively low net pump suction head (NPSH). This design, combined with the relatively low system pressure difference, allows the feed pump 26 and condenser 24 to be mounted at the same elevation and obviates the need for separate condensate and feed pumps. In alternative embodiments, the refrigerant feed pump 26 may be a side channel centrifugal pump or an axial inlet centrifugal pump. The refrigerant feed pump 26 is equipped with an inverter to allow fully proportional variable speed operation across the full range of exhaust conditions. Other pump controls may be used alternatively. Applications using two or more refrigerant feed pumps 26 offer the advantage of redundancy. In some embodiments, the piping 74 disposed immediately aft of each of the feed pumps 26 are connected to one another by a cross-over piping segment 76. Multiple refrigerant feed pumps 26 and the cross-over segment 76 enhance the ability of the ORC device 20 to accommodate a marine environment having significant pitch and roll by collecting working medium at different locations in the condenser 24. ORC configurations having more than one turbo-generator 22 and more than one refrigerant feed pump 26 may be provided with valves 66 (see FIGS. 7-10) that enable each turbo-generator 22 or feed pump 26 to be selectively removed from the working medium flow pattern. Alternatively, a feed pump 26 may be associated with each turbo-generator 22, and selective actuation of the associated feed pump 26 can be used to engage/disengage the associated turbo-generator 22.

The ORC device 20 configurations shown in FIGS. 7-10 each includes a cooling circuit 68 used in marine applications, wherein a cooling medium (e.g., seawater) is accessed from a cooling medium source 70 (e.g., the body of water in the environment surrounding the marine vessel) and circuitously passed through the condenser 24 (via the coolant inlet and exit ports 50,52) and returned to the cooling medium source 70. In alternative embodiments, the cooling circuit 68 includes a heat exchanger (e.g., a cooling tower) to remove thermal energy from the cooling medium.

ORC device 20 configurations are shown schematically in FIGS. 7-10. These configurations represent examples of ORC device 20 configurations and should not be interpreted as the only configurations possible within the present invention. Arrows indicate the working medium flow pattern within each configuration.

Figure 7:
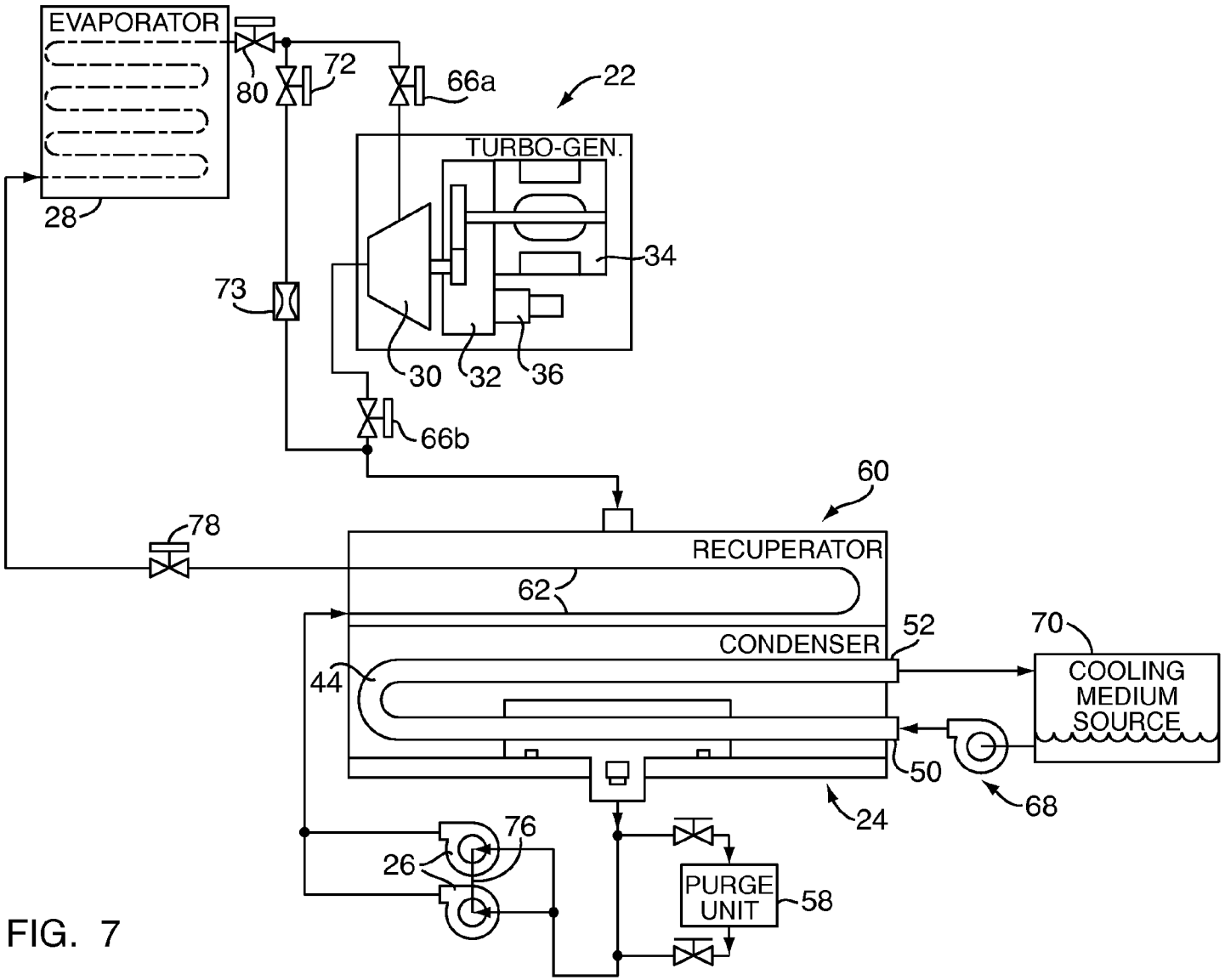
FIG. 7 is a schematic diagram of an ORC device that includes a single turbo-generator.

Referring to a first configuration shown in FIG. 7, beginning at a pair of refrigerant feed pumps 26, working medium is pumped toward an evaporator 28. In the embodiment shown in FIG. 7, prior to entering the evaporator 28, the working medium passes through a recuperator 60, wherein the working medium is preheated. In a marine application, the evaporator 28 is disposed within an exhaust duct that receives exhaust products from the vessel's power plant. Working medium exiting the evaporator 28 subsequently travels toward the turbo-generator 22. A bypass valve 72, disposed between the evaporator 28 and the turbo-generator 22, enables the selective diversion of working medium around the turbo-generator 22 and toward the condenser 24. An orifice 73 is disposed downstream of the bypass valve 72 to produce a flow restriction. As will be discussed below, the bypass valve 72 is operable to fully bypass working medium around the turbo-generator 22. Alternatively, the bypass valve 72 can operate to selectively vary the amount of working medium that is introduced into the turbo-generator 22. Assuming some, or all, of the working medium has not been diverted around the turbo-generator 22, the working medium enters the turbine 30 portion of the turbo-generator 22 and provides the energy necessary to power the turbo-generator 22. Once through the turbo-generator 22, the working medium travels toward the condenser 24. Working medium that is diverted around the turbo-generator 22 also travels toward the condenser 24. A perspective view of this configuration of the ORC device 20 is shown in FIG. 1, less the evaporator 28.

Figure 2:
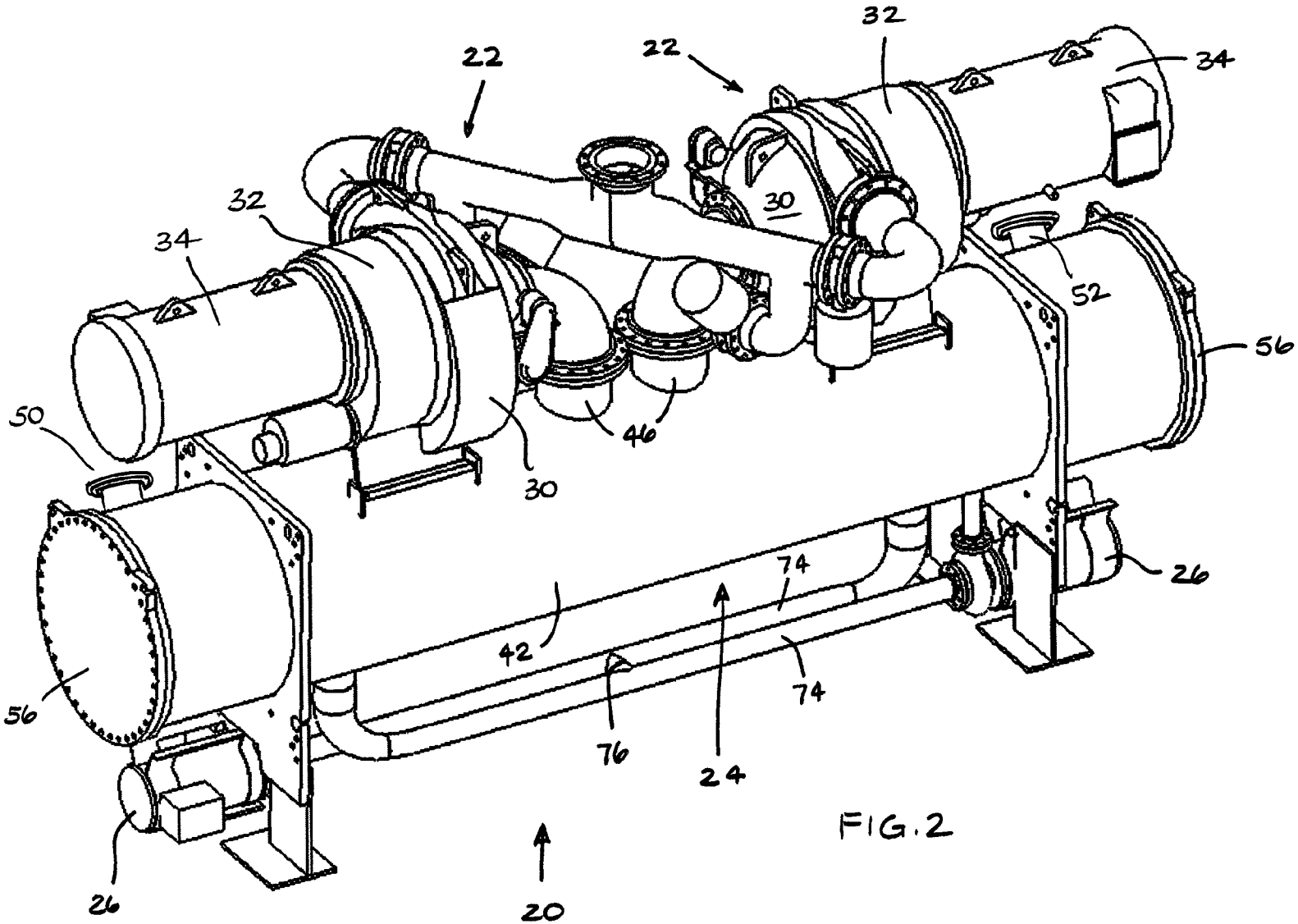
FIG. 2 is a diagrammatic perspective view of an embodiment of the present invention ORC device, having a pair of turbo-generators.
Figure 8:
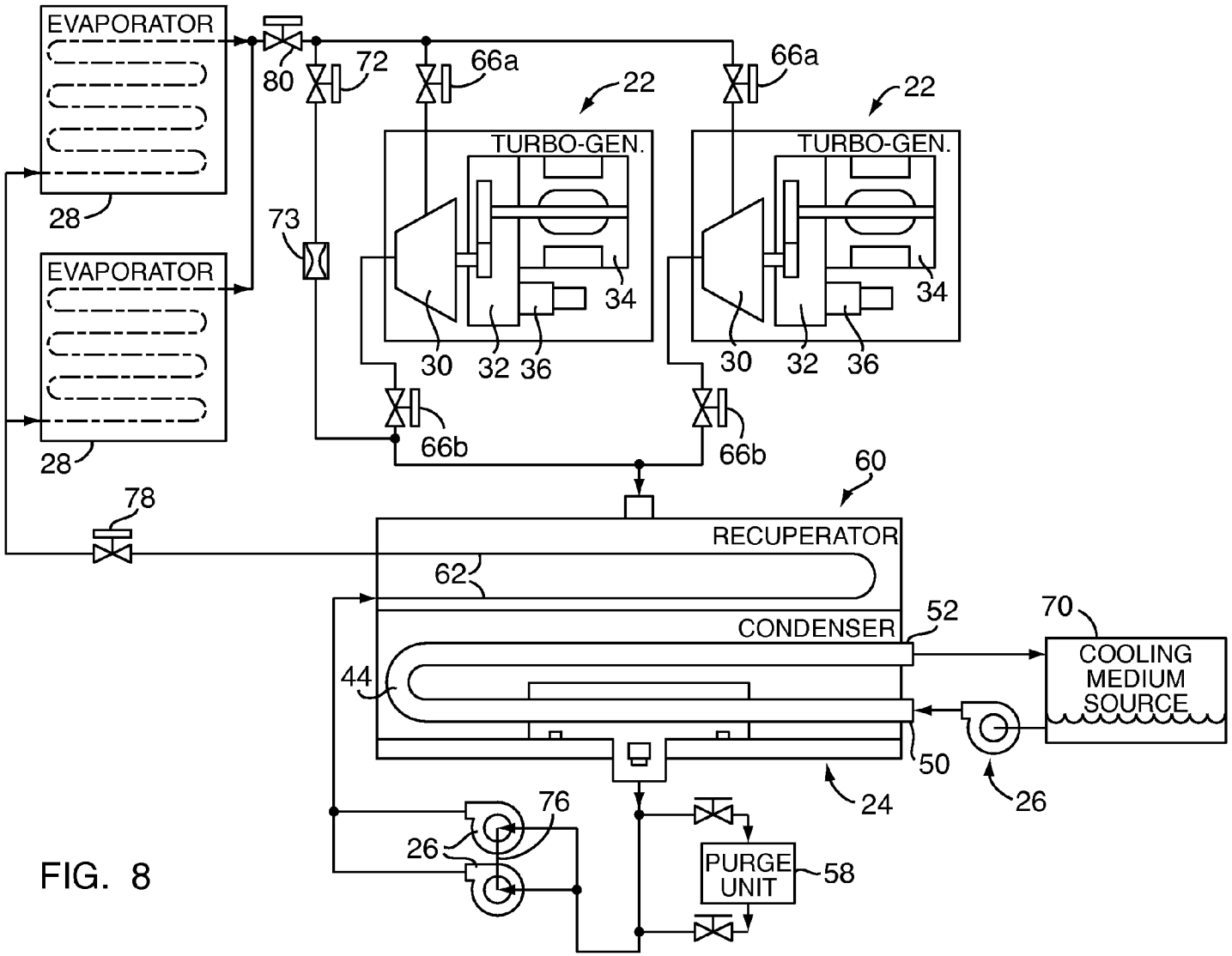
FIG. 8 is a schematic diagram of an ORC device that includes a pair of turbo-generators.

A second ORC device 20 configuration is schematically shown in FIG. 8 that includes a pair of turbo-generators 22. The turbine inlets are connected to a feed conduit from the evaporator 28. A turbine inlet valve 66*a* is disposed immediately upstream of each turbo-generator 22. In some embodiments, a turbine exit valve 66*b* is disposed immediately downstream of each turbo-generator 22. In those embodiments, a safety pressure bleed is provided connected to the low pressure side of the ORC device. The second ORC device 20 configuration also includes a plurality of evaporators 28. An evaporator inlet valve 78 is disposed immediately upstream of each evaporator 28. In some embodiments, an evaporator exit valve 80 is disposed immediately downstream of each evaporator 28. A perspective view of this configuration of the ORC device 20 is shown in FIG. 2, less the evaporator 28.

Figure 3:
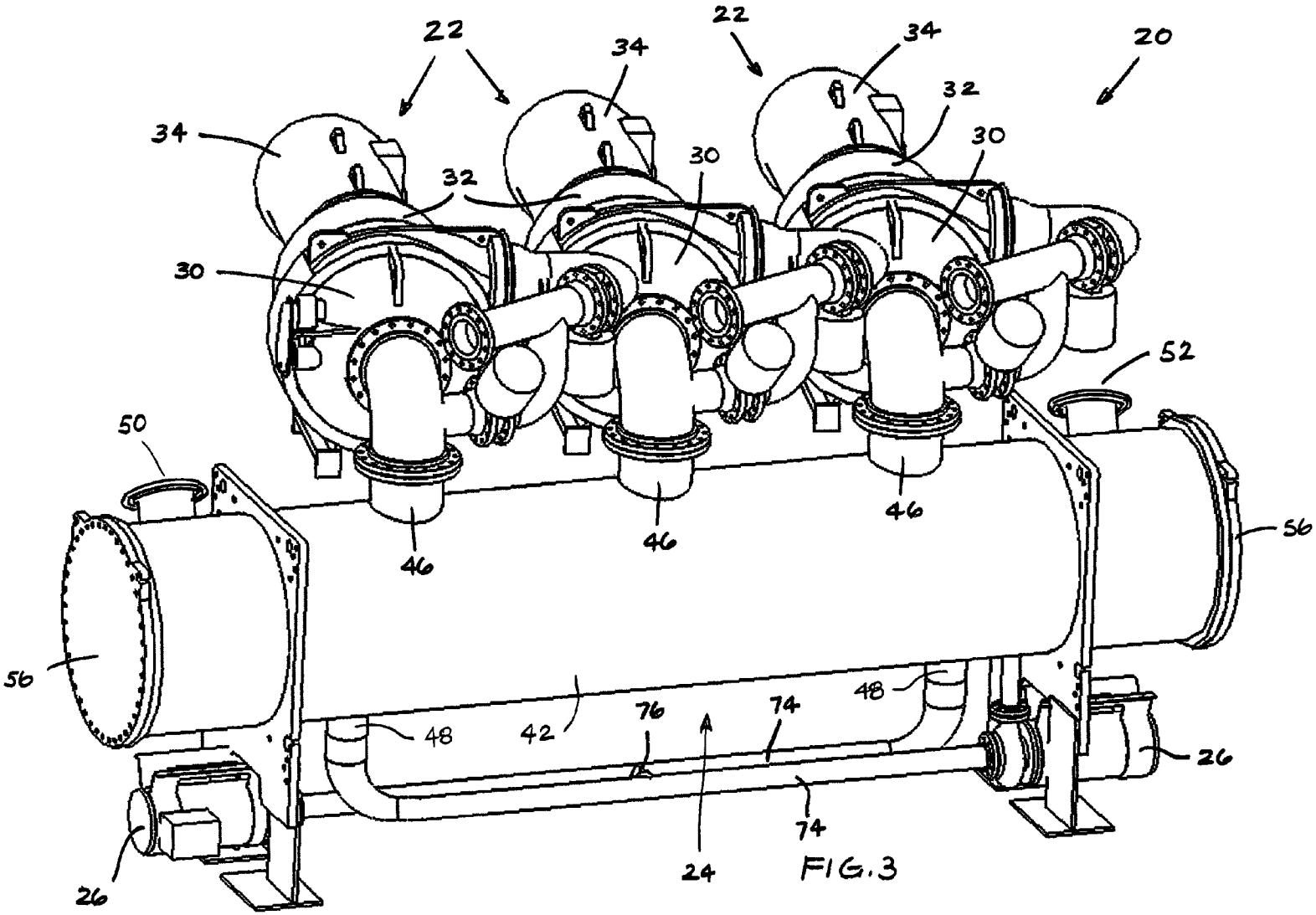
FIG. 3 is a diagrammatic perspective view of an embodiment of the present invention ORC device, having three turbo-generators and a single condenser.
Figure 9:
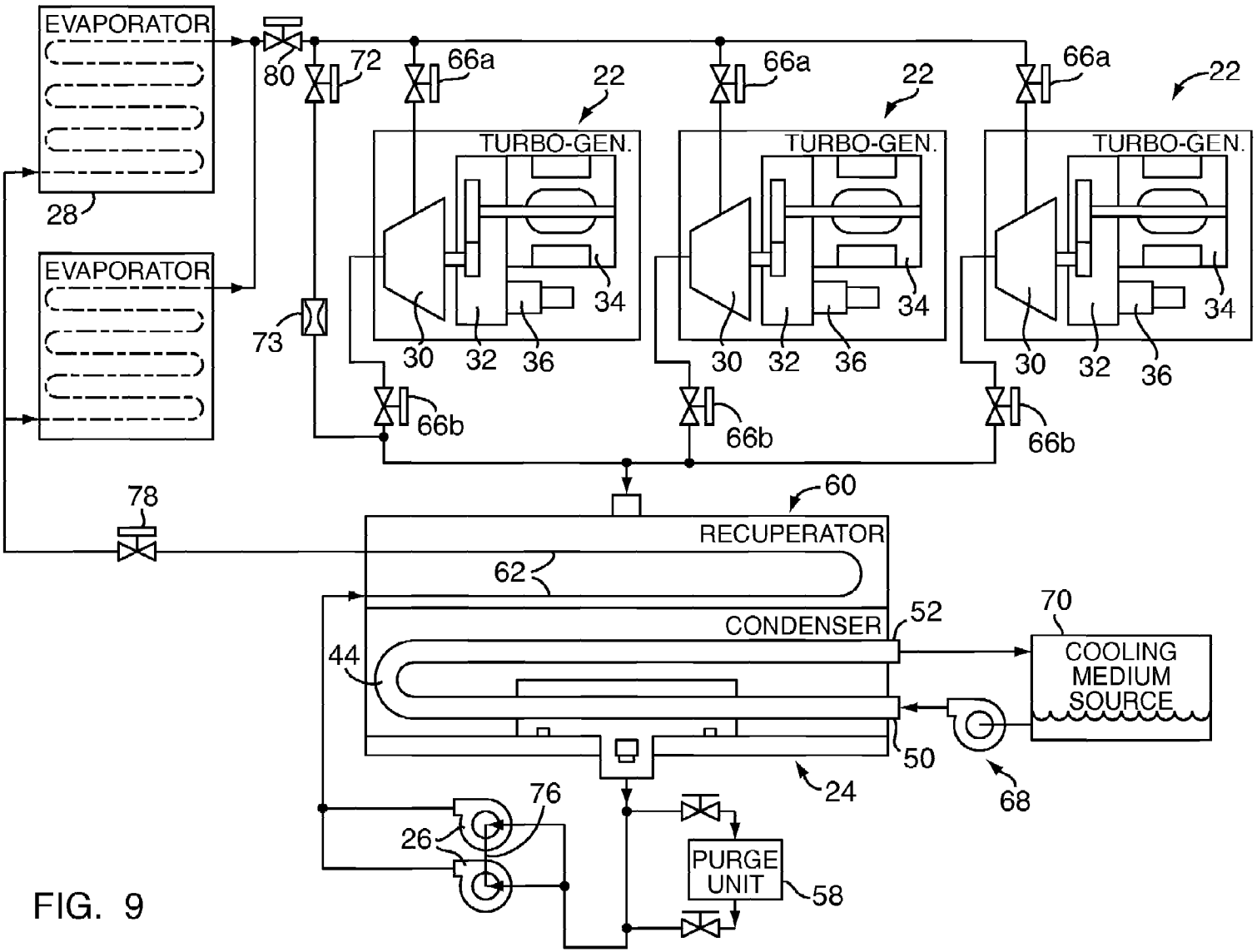
FIG. 9 is a schematic diagram of an ORC device that includes three turbo-generators.

A third ORC device 20 configuration is schematically shown in FIG. 9 that includes three turbo-generators 22. A perspective view of a portion of this configuration of the ORC device 20 is shown in FIG. 3, less the evaporator 28.

Figure 4:
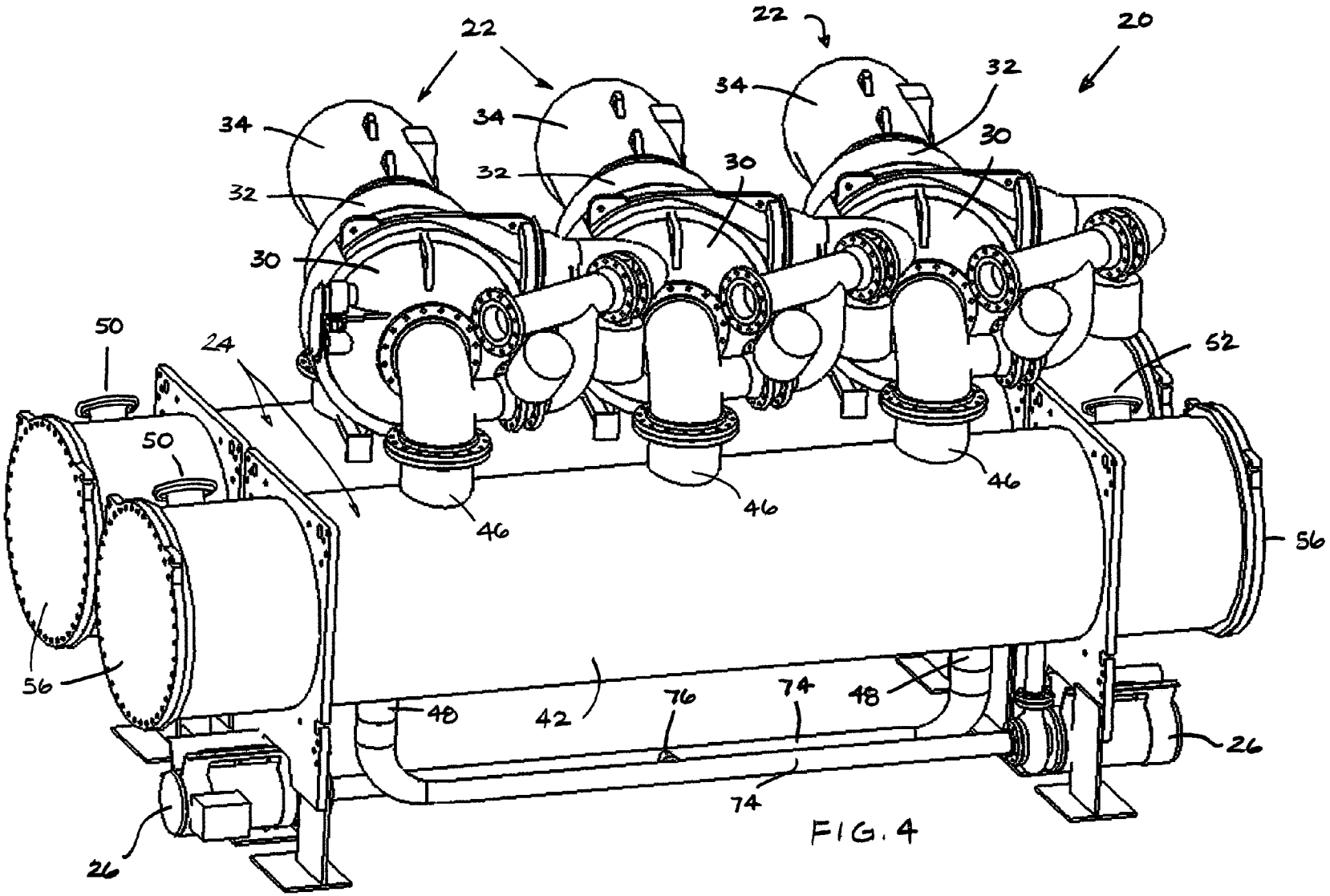
FIG. 4 is a diagrammatic perspective view of an embodiment of the present invention ORC device, having three turbo-generators and a pair of condensers.
Figure 10:
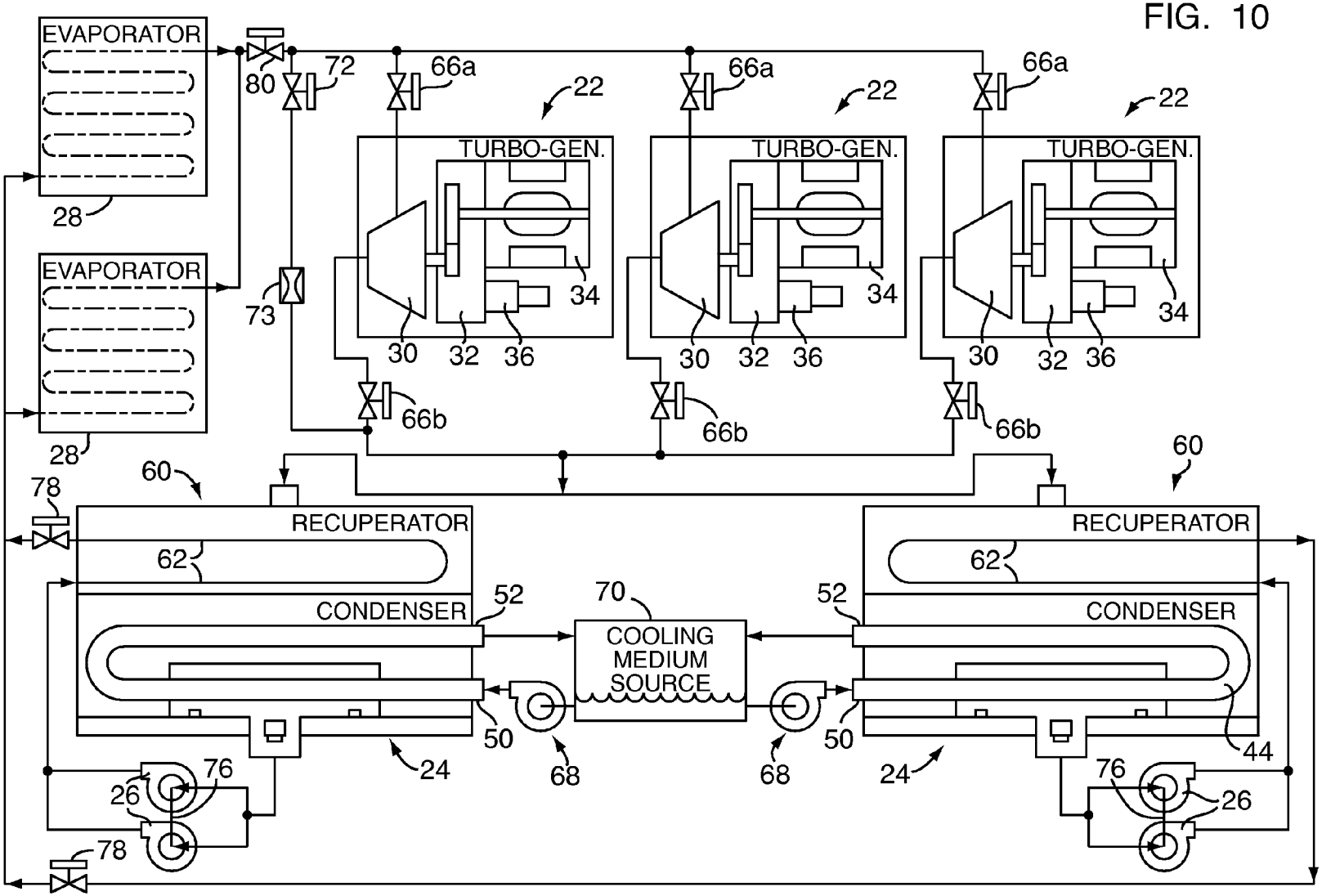
FIG. 10 is a schematic diagram of an ORC device that includes three turbo-generators and a pair of condensers.

A fourth ORC device 20 configuration is schematically shown in FIG. 10 that includes three turbo-generators 22 and a pair of condensers 24. A perspective view of a portion of this configuration of the ORC device 20 is shown in FIG. 4, less the evaporator 28.

In all of the configurations, the ORC controls maintain the ORC device 20 along a highly predictable programmed turbine inlet superheat/pressure curve though the use of the variable speed feed pump 26 in a closed hermetic environment. The condenser load is regulated via the feed pump(s) 26 to maintain condensing pressure as the system load changes. In addition to the primary feed pump speed/superheat control loop, the ORC controls can also be used to control: 1) net exported power generation by controlling either hot gas blower speed or bypass valve 72 position depending on the application; 2) selective staging of the generator 34 and gearbox 32 oil flow; and 3) actuation of the purge unit 58. The ORC controls can also be used to monitor all ORC system sensors and evaluate if any system operational set point ranges are exceeded. Alerts and alarms can be generated and logged in a manner analogous to the operation of a commercially available chillers, with the control system initiating a protective shutdown sequence (and potentially a restart lockout) in the event of an alarm. The specific details of the ORC controls will depend upon the specific configuration involved and the application at hand. The present invention ORC device 20 can be designed for fully automated unattended operation with appropriate levels of prognostics and diagnostics.

The ORC device 20 can be equipped with a system enable relay that can be triggered from the ORC controls or can be self-initiating using a hot gas temperature sensor. After the ORC device 20 is activated, the system will await the enable signal to begin the autostart sequence. Once the autostart sequence is triggered, fluid supply to the evaporator 28 is ramped up at a controlled rate to begin building pressure across the bypass valve 72 while the condenser load is matched to the system load. When the control system determines that turbine superheat is under control, the turbine oil pump is activated and the generator 34 is energized as an induction motor. The turbine speed is thus locked to the grid frequency with no requirement for frequency synchronization. With the turbine at speed, the turbine inlet valve 66*a* opens automatically and power inflow to the generator 34 seamlessly transitions into electrical power generation.

Shutdown of the ORC device 20 is equally straightforward. When the temperature of the exhaust products passing through the evaporator(s) 28 falls below the operational limit, or if superheat cannot be maintained at minimum power, the ORC controls system begins an auto-shutdown sequence. With the generator 34 still connected to the grid, the turbine inlet valve 66*a* closes and the turbine bypass valve 72 opens. The generator 34 once again becomes a motor (as opposed to a generator) and draws power momentarily before power is removed and the unit coasts to a stop. The refrigerant feed pump 26 continues to run to cool the evaporator 28 while the condenser 24 continues to reject load, eventually resulting in a continuous small liquid circulation through the system. Once system temperature and pressure are adequate for shutdown, the refrigerant feed pump 26, turbine oil pump, and condenser 24 are secured and the system is ready for the next enable signal.

When the autostart sequence is complete, the control system begins continuous superheat control and alarm monitoring. The control system will track all hot gas load changes within a specified turndown ratio. Very rapid load changes can be tracked. During load increases, significant superheat overshoot can be accommodated until the system reaches a new equilibrium. During load decreases, the system can briefly transition to turbine bypass until superheat control is re-established. If the supplied heat load becomes too high or low, superheat will move outside qualified limits and the system will (currently) shutdown. From this state, the ORC device 20 will again initiate the autostart sequence after a short delay if evaporator high temperature is present.

Although this invention has been shown and described with respect to the detailed embodiments thereof, it will be understood by those skilled in the art that various changes in form and detail thereof may be made without departing from the spirit and the scope of the invention.

What is claimed is:

1. An apparatus for generating power using a heat stream, the apparatus comprising:

an evaporator operable to be disposed within the heat stream;

a first turbo-generator that includes a turbine coupled with an electrical generator, the first turbo-generator connected to the evaporator to receive refrigerant from the evaporator;

a second turbo-generator that includes a turbine coupled with an electrical generator, the second turbo-generator connected to the evaporator in parallel to the first turbo-generator to receive refrigerant from the evaporator;

a condenser connected to the first turbo-generator and the second turbo-generator to receive refrigerant therefrom, the condenser having a first shell-side exit port at a first location, a second shell-side exit port at a second location and a plurality of tubes disposed within a housing, the plurality of tubes configured to permit a flow of coolant to enter the condenser, flow through the plurality of tubes and exit the condenser;

a first refrigerant feed pump connected to the first shell-side exit port of the condenser to pump refrigerant from the condenser to the evaporator; and a second refrigerant feed pump connected to the second shell-side exit port of the condenser to pump refrigerant from the condenser to the evaporator.

2. The apparatus of claim 1, and further comprising a coolant source that provides the flow of coolant to the condenser.

3. The apparatus of claim 2, wherein the coolant source is environmental water.

4. The apparatus of claim 2, and further comprising a selectively operable bypass valve connected to the evaporator and positioned to provide a path between the evaporator and the condenser, so that refrigerant may be selectively bypassed around at least one of the first turbo-generator and the second turbo-generator.

5. The apparatus of claim 2, and further comprising:

a first selectively operable bypass valve connected to the evaporator and positioned to provide a path between the evaporator and the condenser, so that refrigerant may be selectively bypassed around the first turbo-generator; and a second selectively operable bypass valve connected to the evaporator and positioned to provide a path between the evaporator and the condenser, so that refrigerant may be selectively bypassed around the second turbo-generator.

6. The apparatus of claim 1, and further comprising a recuperator disposed within the housing of the condenser, the recuperator configured to receive refrigerant pumped from the condenser by the first refrigerant feed pump or the second refrigerant feed pump and discharge refrigerant to the evaporator.

7. The apparatus of claim 1, wherein the condenser has a selectively removable access panel attached to a first axial end of the housing, wherein removal of the access panel permits access to the plurality of tubes.

8. The apparatus of claim 1, wherein the heat stream is an exhaust from a power plant.

9. The apparatus of claim 8, wherein the power plant is aboard a marine vessel.

10. The apparatus of claim 1, further comprising a cross-over piping segment operable to connect the first refrigerant feed pump to the second refrigerant feed pump.

11. The apparatus of claim 1, wherein the first shell-side exit port of the condenser is located at a first end of the condenser, and the second shell-side exit port of the condenser is located at a second end of the condenser, opposite the first end.

* * * * *